US006441547B1

(12) United States Patent
Van Alphen et al.

(10) Patent No.: US 6,441,547 B1
(45) Date of Patent: Aug. 27, 2002

(54) CATHODE RAY TUBE WITH NARROWED NECK PORTION

(75) Inventors: Willem M. Van Alphen; Daniël Den Engelsen; Mark N. Jonkhof; Michiel H. Wassink; Ronald Van Der Wilk; Antonius H. J. Willems, all of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/406,646

(22) Filed: Sep. 27, 1999

(30) Foreign Application Priority Data

Sep. 30, 1998 (EP) ..... 98203290

(51) Int. Cl.[7] ..... H01J 29/86
(52) U.S. Cl. ..... 313/477 R; 313/440
(58) Field of Search ..... 313/477 R, 477 HC, 313/440, 482, 426, 414, 318.05; 335/210, 212

(56) References Cited

U.S. PATENT DOCUMENTS 3,939,376 A * 2/1976 Reash ..... 313/481
5,710,480 A * 1/1998 Uchida et al. ..... 313/414
5,818,155 A * 10/1998 Kawamura et al. .... 313/318.05
5,898,264 A * 4/1999 Nose et al. ..... 313/477 HC
5,942,844 A * 8/1999 Nakamura et al. ..... 313/414

* cited by examiner

*Primary Examiner*—Michael H. Day

(57) ABSTRACT

A color cathode ray tube comprises an electron gun and a deflection unit, the electron gun being arranged in a neck portion of an envelope, and the deflection unit being arranged around the envelope. The neck portion of the envelope includes a first part in which the electron gun is arranged. Behind this first part, the neck portion narrows (the outside diameter decreases). The deflection unit is at least partly provided around this narrowed part.

7 Claims, 6 Drawing Sheets

CATHODE RAY TUBE WITH NARROWED NECK PORTION

BACKGROUND OF THE INVENTION

The invention relates to a cathode ray tube comprising an evacuated envelope in a neck portion of which there is situated an electron gun for generating three electron beams, and an electromagnetic deflection unit, outside the envelope, for deflecting the electron beams across a display screen.

The invention also relates to a method of manufacturing a cathode ray tube. Cathode ray tubes of the type mentioned in the opening paragraph are known. They are used, inter alia, in television receivers and computer monitors.

For a cathode ray tube, the quality of the image display is very important. Besides, the energy consumption and the depth dimension of the cathode ray tube are important too.

SUMMARY OF THE INVENTION

It is an object of the invention to provide a cathode ray tube in which an improved image display is possible, and in which the energy consumption can be reduced without the necessity of increasing the depth dimension of the cathode ray tube.

To achieve this, the cathode ray tube in accordance with the invention is characterized in that the neck portion includes a first part in which the electron gun is situated and a narrower second part located behind the electron gun, the largest distance between the centerlines of the electron beams upon leaving the gun ranging between 8 and 14 mm, and the deflection unit extending at least partly around the narrower part of the neck.

In a cathode ray tube, the image quality is determined, inter alia, by the largest distance between the electron beams, and the distance between the electron beams and the outer circumference of the neck portion where the deflection unit is situated.

In an electron gun there is a lens portion for focusing the electron beams. The quality of the lens is determined to a substantial degree by the size of the lens, which is determined by the shape and the size of the apertures in electrodes in the electron gun. The larger the distance between the electron beams, the larger the maximum lens diameter and the higher the lens quality is. The higher the lens quality, the better the electron beams can be focused on the display screen. However, as the distance between the beams increases, the distance between the electron beams in the deflection unit increases too, which has a negative effect on the accuracy with which the electron beams are deflected across the display screen. Particularly the convergence of the beams on the display screen is negatively influenced by an increase of the distance between the electron beams. In addition, the energy of the magnetic field necessary for deflecting the electron beams increases. Customarily, at each deflection stroke, this energy is transferred from the coil to a capacitive unit where it is stored. The transport losses involved are dissipated in the deflection unit which, as a result, is subject to an increase in temperature and heats up surrounding parts. An increase of the deflection frequency causes an increase in energy loss, since more energy transports between deflection unit and capacitive unit will take place per unit of time. This increase in temperature causes so-called thermal drift, which adversely affects the image displayed. Consequently, an increase or a reduction of the distance between the electron beams has opposite effects on the image and the deflection in a known cathode ray tube. In the cathode ray tube in accordance with the invention, the diameter of the neck exhibits a reduction behind the electron gun. As a result, the deflection unit can be provided closer to the beams, which results in an improved image quality and a reduced energy consumption. If the largest distance between the beams is less than 8 mm, then the quality of the lens will generally insufficiently meet present quality requirements. If the distance between the beams is more than 14 mm, then the energy consumption and the resultant thermal drift are generally too high.

Preferably, the narrower part has an outside diameter which is smaller than twice the distance between the electron beams. This enables a substantial reduction in energy consumption relative to the current designs to be achieved.

In electron guns of the so-called in-line type, in which three co-planar electron beams are generated, the largest distance between electron beams is formed by the distance between the outermost electron beams, i.e. the so-called red and blue electron beams. In electron guns of the so-called Delta type, the largest distance between electron beams is formed by the distance between two random electron beams.

Preferably, the electron gun is provided with a centring cup having a length below 5 mm, and preferably below 3 mm. In a known electron gun, the length of the centring cup is approximately 7–8 mm. By reducing the length of the centring unit, the electron gun can be arranged closer to the deflection unit. As a result, the depth dimension of the cathode ray tube is reduced.

Preferably, the cathode ray tube is provided with a deflection unit including deflection coils and a deflection-coil support which, on one side, exhibits a neck-shaped aperture, said deflection coil support having means for reversibly widening the neck-shaped aperture, such that the deflection coil support constitutes a coherent whole.

By virtue thereof, the deflection coil support can be readily provided on the envelope of the cathode ray tube.

These and other aspects of the invention will be apparent from and elucidated with reference to the embodiments described hereinafter.

BRIEF DESCRIPTION OF THE DRAWING

In the drawing.

The Figures are not drawn to scale. In the Figures, like reference numerals generally refer to like parts.

DESCRIPTION OF THE PREFERRED EMBODIMENT

Figure 1:
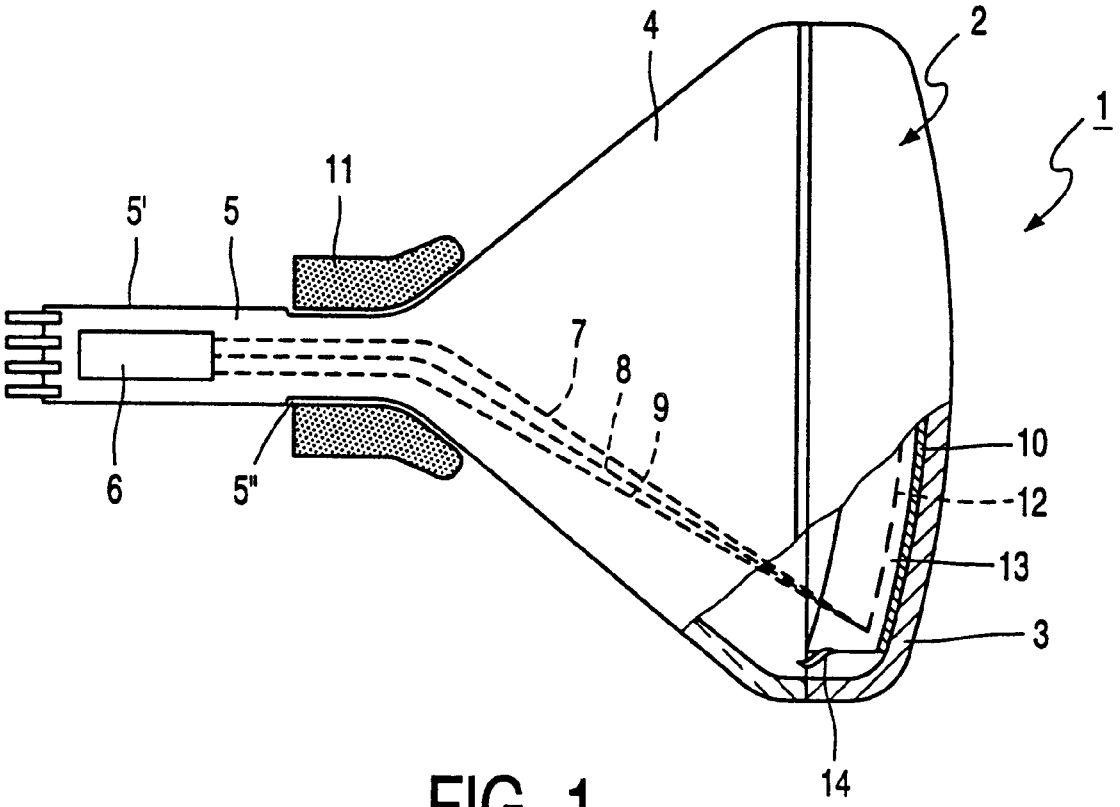
FIG. 1 is a sectional view of a cathode ray tube in accordance with the invention.

The cathode ray tube (FIG. 1) is a color cathode ray tube 1 which comprises an evacuated envelope 2 including a display window 3, a cone portion 4 and a neck 5. Said neck 5 accommodates an electron gun 6 for generating three electron beams 7, 8 and 9 which extend in one plane, the in-line plane. The inner surface of the display window is provided with a display screen 10. Said display screen 10 has a large number of phosphor elements luminescing in red, green and blue. On their way to the display screen 10, the electron beams 7, 8 and 9 are deflected across the display screen 10 by means of deflection unit 11 and pass through a color selection electrode 12 which is arranged in front of the display window 3 and which includes a thin plate with apertures 13. The three electron beams 7, 8 and 9 pass through the apertures 13 of the color selection electrode at a small angle and, consequently, each electron beam impinges only on phosphor elements of one color. In this example, the color selection electrode 12 is suspended by means of suspension means 14. The neck 5 comprises a first wide portion 5' and a narrower second portion 5".

Figure 2:
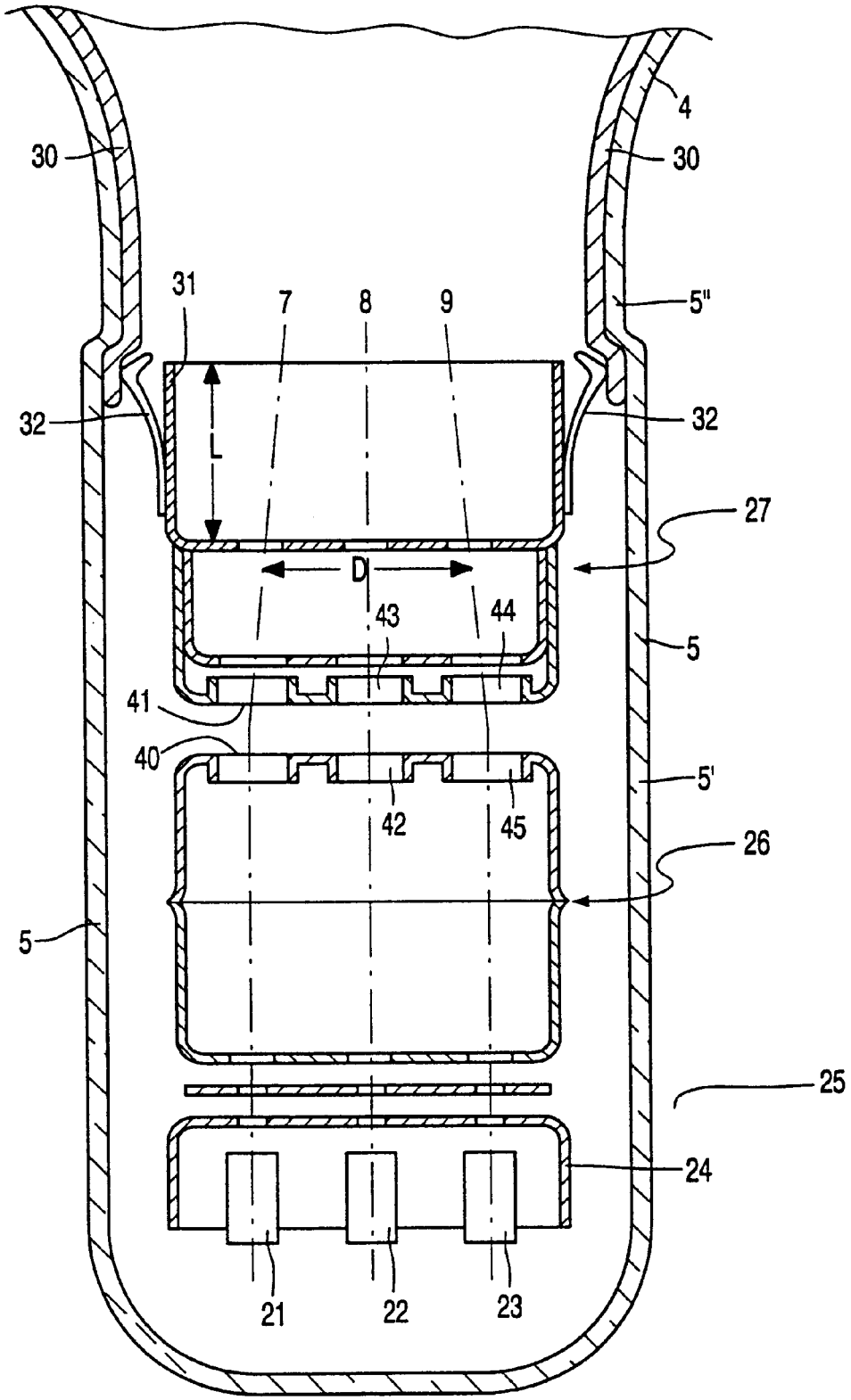
FIG. 2 is a sectional view of a detail of the cathode ray tube shown in FIG. 1.

FIG. 2 is a sectional view of a detail of the cathode ray tube of FIG. 1. The neck portion 5' accommodates the electron gun 6. Said electron gun contains three cathodes 21, 22 and 23, and a number of electrodes 24, 25, 26 and 27, a main lens being formed between the electrodes 26 and 27. A conductive layer 30 is applied to the cone portion 4. A centring cup 31 is secured to the electrode 27. The length L of the centring cup in known cathode ray tubes is approximately 7–8 mm. In a cathode ray tube in accordance with the invention, preferably $L \leqq 5$ mm. A number of contact springs 32 are used to retain the electron gun and center it relative to the envelope 2. These contact springs contact the conductive layer 30 and are connected to the centring unit 31. During operation, the conductive layer 30 carries a high voltage.

The quality of the main lens is substantially determined by the size of the apertures 40, 41, 42, 43, 44 and 45 in electrodes 26 and 27. The apertures may or may not demonstrate an overlap, that is partly blend with each other. The larger the apertures, the higher the maximally attainable quality generally will be of the electron optical lens formed in operation between the apertures. The size of the apertures is also determined by the distance D between the outermost electron beams 7 and 8. Hence, it applies that the lens quality can increase as the distance D increases.

Figure 3:
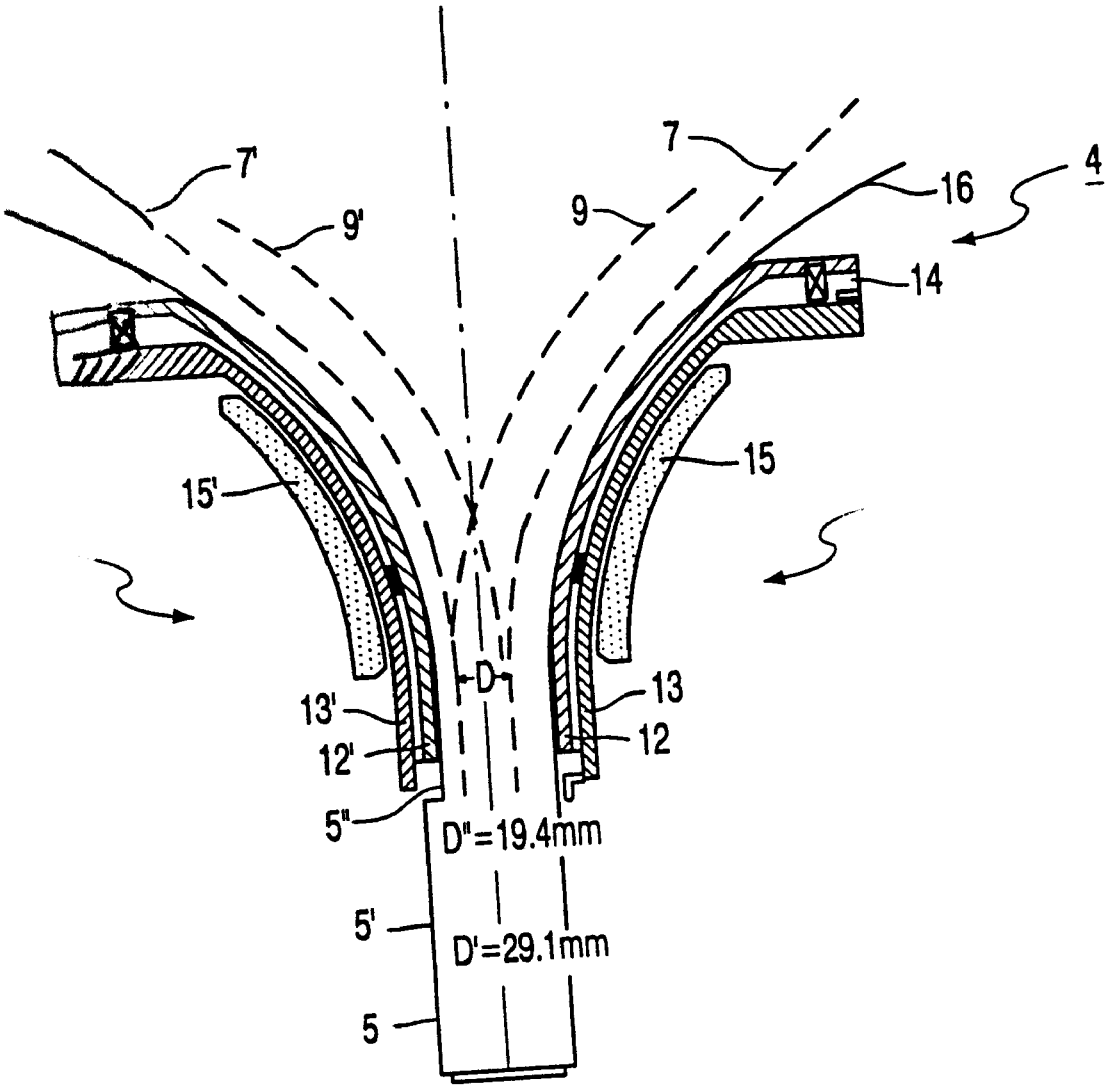
FIG. 3 schematically shows a detail of a cathode ray tube in which the difference between the known cathode ray tube and a cathode ray tube in accordance with the invention is shown.

FIG. 3 schematically shows a neck 5. The portion 5' accommodates an electron gun (not shown in the drawing for simplicity's sake). On the right-hand side, a known deflection unit on a known cathode ray tube is schematically shown. The deflection unit includes a first coil system 12, a second coil system 13 on a support 14 and a yoke ring 15. The deflection unit engages or substantially engages the periphery 16 of the cone portion 4. The distance between the outermost electron beam 9, shown in a very deflected state, and the deflection unit 11 increases as the distance D between the beams increases. An increase of the distance between the outermost beams and the deflection unit has a number of negative effects. The accuracy with which the beams can be deflected decreases, which adversely affects the image quality, and the power necessary to deflect the beams increases. As the power generated in the deflection unit increases, also the transport losses and hence the temperature of the deflection unit exhibit an increase. Temperature changes generally have a negative effect on the image quality; particularly so-called convergence drift is a phenomenon which occurs.

On the left-hand side, the Figure schematically shows a cathode ray tube in accordance with the invention. The neck portion 5 comprises a first part 5' and a second part 5", the outside diameter D' of the first part 5' being larger than the outside diameter D" of the second part 5". The first part 5' accommodates the electron gun with the main lens, while in the second part, in operation, electron beams are deflected. The distance between the electron beams 7' and the deflection unit 11", particularly the deflection coils 13' and 12', is much smaller. As a result, the sensitivity and accuracy of the deflection increases and the energy consumption decreases.

Figure 4A:
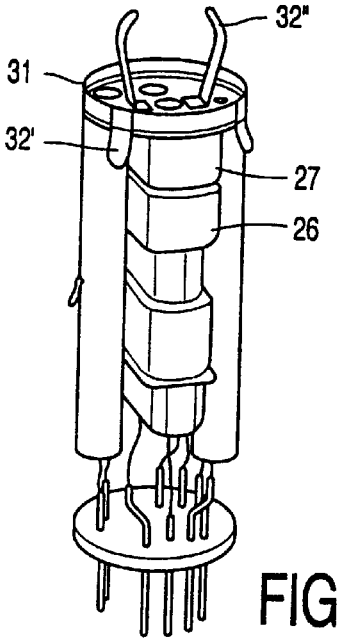
FIG. 4A shows an electron gun which can suitably be used for a cathode ray tube in accordance with the invention.
Figure 4B:
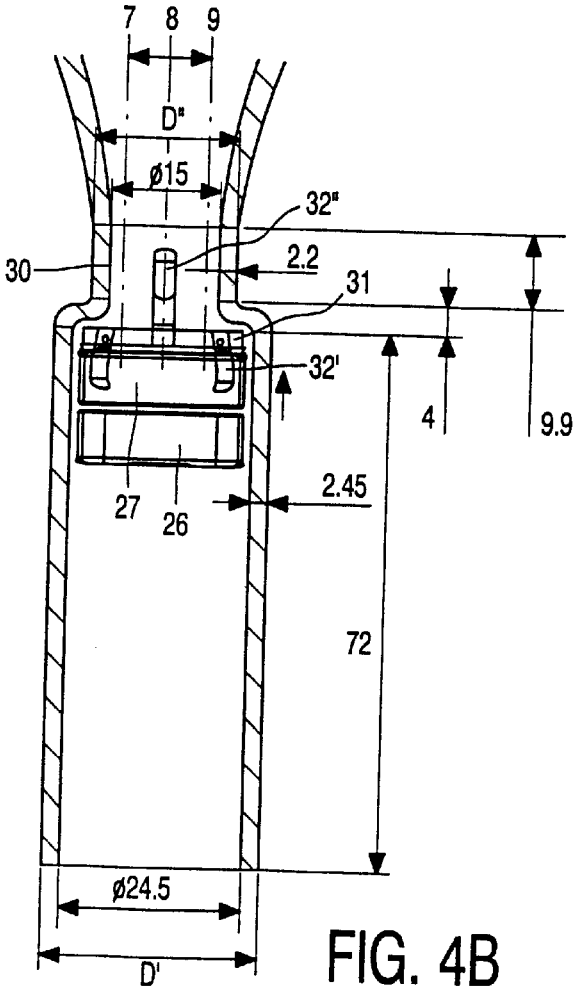
FIG. 4B is a sectional view of a detail of a cathode ray tube in accordance with the invention.

FIGS. 4A and 4B show a detail of an embodiment of the invention. In this example, D is 11 mm, D' (equal to the outside diameter of a known cathode ray tube) is 29.4 mm, and the outside diameter of the narrower portion D" is 19.4 mm. The ratio between the distance D and the outside diameter of the narrower portion is 19.4/11=1.8, while in the known cathode ray tube this ratio is 29.4/11=2.6. The centring cup 31 has a substantially reduced length. Preferably, the length of the centring cup is less than 5 mm, and most preferably smaller than 2 mm. By virtue thereof, the main lens can be situated closer to the transition between the parts 5' and 5", resulting in a reduction in length of the tube. A reduction of the length of the tube leads to a reduction of the weight of the cathode ray tube.

In this example, which is a preferred embodiment, the electron gun is provided with a number of centring springs 32' and 32", a number of which, i.e. centring springs 32", face the screen, and a number, i.e. centring springs 32', face in the opposite direction. Preferably, as shown in this example, the springs 32" are not situated in the plane of the electron beam (in this example, the in-line plane). In this example, the springs 32" are situated below and above the in-line plane. By virtue thereof, they can bring about the contact between the gun and a conductive layer 30 in the narrowed neck, without the risk that, during the deflection of the electron beams, the electron beams (or a part thereof) are incident on the springs. The springs 32' are responsible for centring the gun in the wide part of the neck. This construction, in which springs 32' and 32" are used constitutes a preferred embodiment relative to an embodiment in which, as in the known electron gun, all centring springs are directed towards the screen, since the gun is clamped both in part 5' and in part 5" and hence centred in two planes. This results in an improved alignment of the electron gun. Electrodes 26 and 27 (see FIG. 2) are indicated in FIG. 4A. For simplicity's sake, in FIG. 4B only these electrodes are shown; the other components of the electron gun are not shown in FIG. 4B. The neck part 5" is provided with a conductive layer 30. The centring springs 32" electrically contact this conductive layer 30. Preferably, the conductive layer 30 extends to beyond the transition between the parts 5' and 5", but not as far as the centring springs 32'. If the conductive layer extends as far as the centring springs 32', then a part of the conductive layer is situated near the main lens between the electrodes 26 and 27, which adversely affects the operation of the main lens and/or causes problems during sparking of the electron gun. Sparking is a customary process step in the manufacture of an electron gun, by means of which burrs and other irregularities are removed by applying very high voltages between the electrodes. The presence of the conductive layer 30 in the vicinity of the main lens may cause problems because flash-over may take place at the layer, which may lead to the formation of loose parts which cause a short-circuit.

Figure 5:
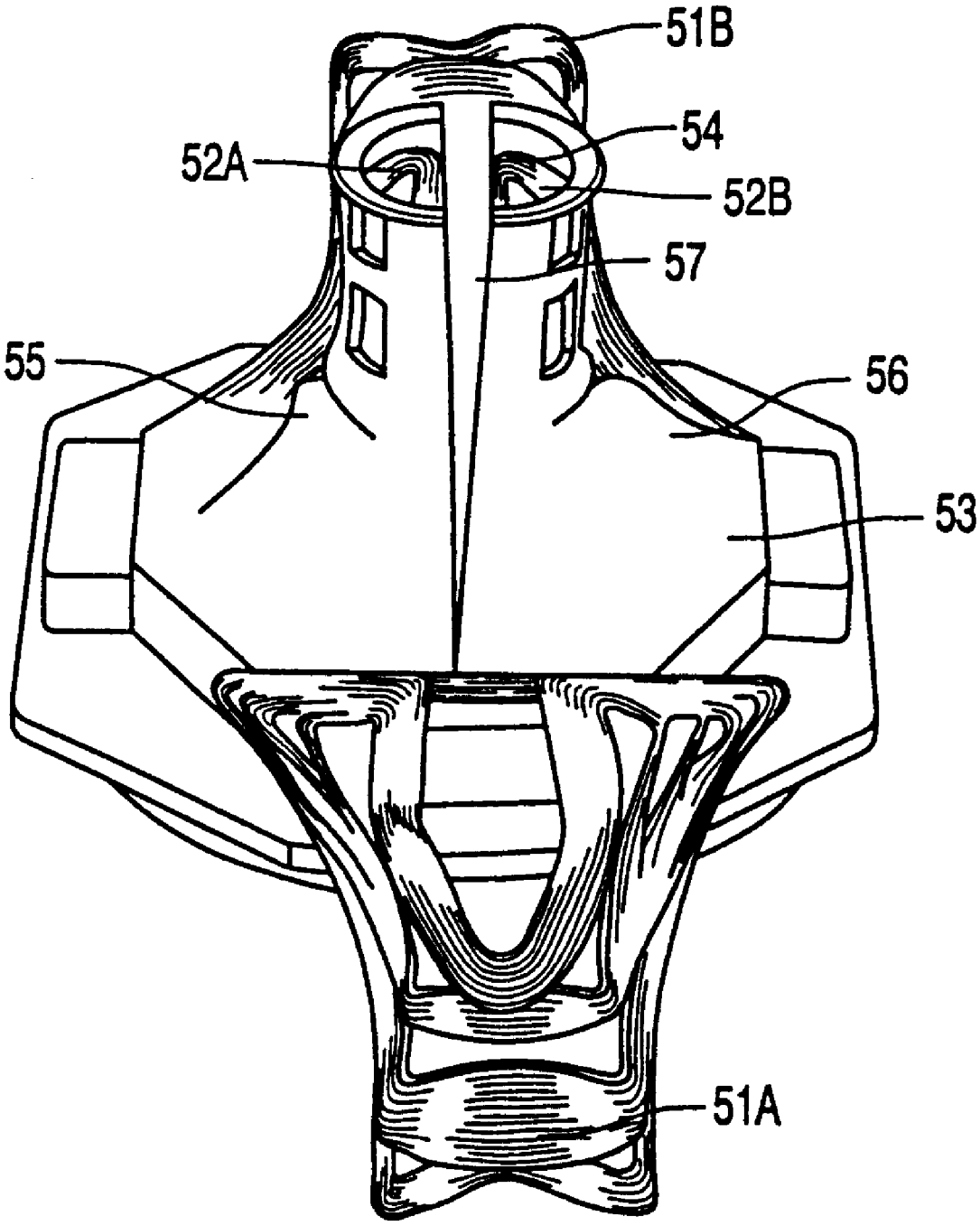
FIG. 5 shows a deflection unit of or for a cathode ray tube in accordance with the invention.

FIG. 5 is a perspective view of a detail of a deflection unit. It shows:

- frame deflection coils 51A and 51B, and line deflection coils 52A and 52B,
- deflection coil support 53, which exhibits a neck-shaped aperture 54 (in this application it is called "neck-shaped aperture" because the aperture comprises the neck or is directed towards the neck of the cathode ray tube when the deflection unit is mounted on the envelope). The line deflection coils 52A and 52B are secured on the inner surfaces of the coil support 53. The deflection coil support 53 comprises two parts 55 and 56, and grooves 57. The grooves 57 extend over a length between the line deflection coils 52A and 52B. By virtue thereof, the neck-shaped aperture can be widened. As a result, it is possible in a simple manner to move the deflection coil support with the widened neck-shaped aperture over the first wide part 5' of the neck and subsequently reduce the size of the neck-shaped aperture, so that the coil support encloses the narrower, second part 5" (see FIG. 3). Since the deflection coil support forms a coherent whole, it constitutes a better reference for the position of the coils than embodiments of the invention which do not include a coil support or which include a coil support composed of two separate parts.

After securing the coil support, the frame deflection coils 51A and 51B are secured to the coil support, whereafter the yoke ring 15' (see FIG. 3) is provided. Matching the deflection unit and the envelope takes place after the provision of the yoke ring. During the matching operation, the position of the yoke ring is adjusted such that a test pattern displayed on the display screen meets prescribed quality requirements.

The invention can be briefly summarized as follows:

A color cathode ray tube comprises an electron gun and a deflection unit, the electron gun being arranged in a neck portion of an envelope, and the deflection unit being arranged around the envelope. Said neck portion of the envelope includes a first part in which the electron gun is arranged. Behind this first part, the neck portion narrows (the outside diameter decreases). The deflection unit is at least partly provided around this narrowed part.

The method in accordance with the invention can be briefly summarized by a method of manufacturing a cathode ray tube comprising an evacuated envelope on which a deflection unit is provided, characterized in that the envelope comprises a neck portion and a cone portion, which neck portion has a first wide part and a narrower second part, the second neck part being located closer to the cone portion than the first part, the deflection unit comprising a deflection coil support having means for reversibly widening an shaped aperture in the neck, said deflection unit forming a coherent whole, and line deflection coils being secured on an inner surface of the coil support, said method comprising the following process steps:

the aperture in the neck is widened, the coil support is provided on the envelope so as to extend beyond the first part of the neck, the aperture in the neck is narrowed, frame deflection coils are provided.

Figure 6A:
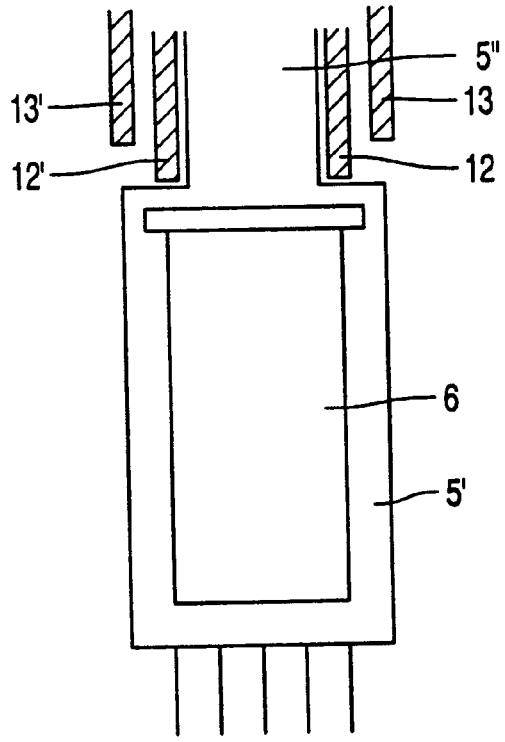
FIGS. 6A and 6B show details of different deflection coil embodiments.
Figure 6B:
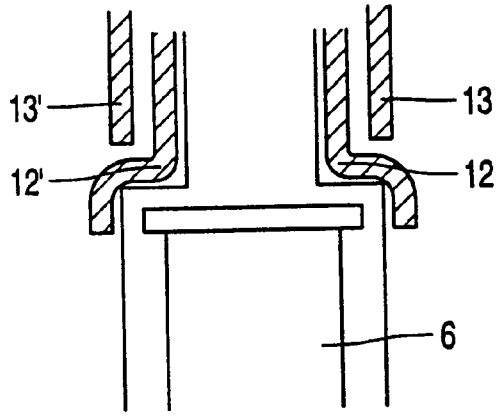

It will be obvious that within the scope of the invention many variations are possible. FIGS. 6A and 6B show two further embodiments. In FIG. 6A, the line coil (12) has a greater length than the frame coil (13). A further embodiment is shown in FIG. 6B, in which the line coil extends beyond the transition from part 5' to part 5". In this embodiment also the line coil 13 may extend beyond the transition from part 5' to 5". This has the advantage that deflection of the electron beams by the deflection field already starts in the upper part of the electron gun 6. By virtue thereof, a reduction of the deflection angle and hence the deflection energy can be achieved.

What is claimed is:

1. A cathode ray tube comprising an evacuated envelope having a neck portion in which there is situated an electron gun for generating three electron beams, and an electromagnetic deflection unit, outside the envelope, for deflecting the electron beams across a display screen, characterized in that the neck portion includes a first part in which the electron gun is situated and a narrower second part through which the electron beams generated by the electron gun pass, the largest distance between the centerlines of the electron beams, upon leaving the electron gun, ranging between 8 and 14 mm, and the deflection unit extending at least partly around the narrower second part of the neck.

2. A cathode ray tube as claimed in claim 1, characterized in that the narrower part of the neck has an outside diameter which is smaller than twice said distance between the electron beams.

3. A cathode ray tube as claimed in claim 1, characterized in that the electron gun has a centring unit with a length below 5 mm.

4. A cathode ray tube as claimed in claim 3, characterized in that the electron gun includes a centring cup having a length below 3 mm.

5. A cathode ray tube as claimed in claim 1, characterized in that the electron gun includes a centring unit provided with springs, a number of said springs facing the display screen, and a number of said springs facing in the opposite direction.

6. A cathode ray tube as claimed in claim 1, characterized in that the cathode ray tube is provided with a deflection unit including deflection coils and a deflection-coil support which, on one side, includes a neck-shaped aperture, said deflection coil support having means for reversibly widening the neck-shaped aperture such that the deflection coil support constitutes a coherent whole.

7. A cathode ray tube as claimed in claim 6, characterized in that the means for reversibly widening have a number of grooves.

* * * * *